US010517382B2

(12) United States Patent
Hwang

(10) Patent No.: US 10,517,382 B2
(45) Date of Patent: Dec. 31, 2019

(54) BRUSH AND ITS MANUFACTURING METHOD

(71) Applicant: F.S. KOREA INDUSTRIES INC., Seoul (KR)

(72) Inventor: Jae Kwang Hwang, Seoul (KR)

(73) Assignee: F.S. KOREA INDUSTRIES INC., Seoul (KR)

( * ) Notice: Subject to any disclaimer, the term of this patent is extended or adjusted under 35 U.S.C. 154(b) by 365 days.

(21) Appl. No.: 15/389,280

(22) Filed: Dec. 22, 2016

(65) Prior Publication Data

US 2017/0181534 A1 Jun. 29, 2017

(30) Foreign Application Priority Data

Dec. 23, 2015 (KR) ..... 10-2015-0184963

(51) Int. Cl.

| | |
|---|---|
| ***A46B 3/08*** | (2006.01) |
| ***A46D 3/00*** | (2006.01) |
| ***A46B 7/00*** | (2006.01) |
| ***A46B 9/02*** | (2006.01) |
| ***A46D 3/08*** | (2006.01) |
| ***A46D 3/04*** | (2006.01) |

(52) U.S. Cl.

CPC ..... *A46B 7/00* (2013.01); *A46B 3/08* (2013.01); *A46B 9/021* (2013.01); *A46D 3/00* (2013.01); *A46D 3/047* (2013.01); *A46D 3/087* (2013.01); *A46B 2200/1046* (2013.01)

(58) Field of Classification Search

CPC .. A46B 3/08; A46B 7/00; A46B 9/021; A46B 2200/1046; A46D 3/00; A45D 40/262

See application file for complete search history.

(56) References Cited

U.S. PATENT DOCUMENTS

| | | | | |
|---|---|---|---|---|
| 6,513,183 | B2 | 2/2003 | Dorf | |
| 9,642,441 | B1 * | 5/2017 | Ajootian | A45D 40/262 |
| 2012/0298130 | A1 * | 11/2012 | Telwar | A46B 3/08 132/317 |
| 2015/0296968 | A1 * | 10/2015 | Hwang | A46B 9/021 15/106 |

FOREIGN PATENT DOCUMENTS

| | | |
|---|---|---|
| KR | 20-0255125 | 12/2001 |
| KR | 10-2013-0102767 | 9/2013 |

* cited by examiner

*Primary Examiner* — Randall E Chin

(74) *Attorney, Agent, or Firm* — Heedong Chae; Lucem, PC

(57) ABSTRACT

The present invention provides a brush and a manufacturing method thereof. A brush of the present invention includes: brush hairs; a brush hair part that has a brush coupler to which the brush hairs are attached; a brush body that support an end of the brush coupler; a coupling member that has a first part coupled to the brush body and a second part coupled to the edge of the brush coupler and has a metallic tube; and a fixing member that prevents shaking of the brush coupler between the brush body and the brush coupler, in which the coupling member and the brush body are combined by pressing the portion of the coupling member where the coupling member and the brush body are in contact with each other.

2 Claims, 14 Drawing Sheets

BRUSH AND ITS MANUFACTURING METHOD

CROSS-REFERENCE TO RELATED APPLICATION

This application claims the benefit of Korean Application No. 10-2015-0184963 filed on Dec. 23, 2015 with the Korean Intellectual Property Office, the disclosure of which is incorporated herein by reference.

BACKGROUND OF THE INVENTION

1. Field of the Invention

The present invention relates to a brush and a manufacturing method thereof and, more particularly, to a brush that is manufactured by mechanically pressing it and a manufacturing method thereof.

2. Description of the Related Art

Make-up for put on makeup is generally provided in a liquid state, a solid state, and a mixed state of liquid and solid. Brushes having various shapes and sizes have been developed and used to apply solid-state make-up to a face.

That is, those brushes enable a user to put make-up that is in a solid powder state on the brushes and then appropriately apply the make-up to a face. Those brushes are composed of a hand that a user can hold with a hand and a plurality of hairs at an end of the handle.

The hairs have been attached to a handle by chemical substances such as an adhesive in the related art. In this case, since the adhesive is a chemical substance and may have a harmful influence on a human body, so using an adhesive that is not harmful to a human body in consideration of this problem increases the manufacturing cost.

Further, since adhesives are vulnerable to heat, when they are exposed to heat, the adhered portion is separated and durability is decreased.

The technical configuration described above is the background for helping understand the present invention, but does not mean the related art that is widely known in the field of the present invention.

RELATED ART DOCUMENT

Patent Document

Korean Utility Model No. 20-0255125 (Jang-Seong Park), Publication Date: 2001.12.13.

SUMMARY OF THE INVENTION

Accordingly, an object of the present invention is to provide a brush that can remove the defects due to using an adhesive by mechanically pressing the brush, and a manufacturing method thereof.

According to an aspect of the present invention, a brush includes: brush hairs; a brush hair part that has a brush coupler to which the brush hairs are attached; a brush body that support an end of the brush coupler; a coupling member that has a first part coupled to the brush body and a second part coupled to the edge of the brush coupler and has a metallic tube; and a fixing member that prevents shaking of the brush coupler between the brush body and the brush coupler, in which the coupling member and the brush body are combined by pressing the portion of the coupling member where the coupling member and the brush body are in contact with each other.

The brush hairs may not be disposed at the outermost edge of the brush coupler and top of the coupling member may be bent and locked to the outermost edge.

The fixing member may include a packing.

The brush body may be made of wood.

The brush body may be made of metal and a pressing groove may be formed at the portion, where the coupling member is pressed, on the brush body.

A cut groove may be formed at the upper portion of the brush body.

The coupling member may be coupled to the brush body by an apparatus for coupling a brush, and the apparatus may include: a brush-fitting unit that is coupled to a main body and couples the coupling member for fixing a brush hair part of the brush to the brush body by pressing the coupling member; a brush-feeding unit that is coupled to the main body to feed the brush to the brush-fitting unit; and a brush-rotating unit that is combined with the brush-feeding unit and rotates the brush.

Further, according to another aspect of the present invention, a method of manufacturing a brush includes: bending the upper end of a coupling member including a metallic tube and coupling the bent upper end to the edge of a brush coupler combined with brush hairs; supporting the brush coupler with a fixing member by inserting the fixing member into the coupling member; inserting the upper portion of a brush body into the coupling member to support the fixing member; and coupling the coupling member to the brush body by pressing a portion of the coupling member where the coupling member and the brush body are in contact with each other.

The coupling member and the brush body may be pressed by an apparatus for combining a brush.

According to embodiments of the present invention, a coupling member and a brush body are combined by pressing the portion of the coupling member where the coupling member and the brush body are in contact with each other, so they can be combined without an adhesive and it is possible to preclude harmful substances of an adhesive.

Further, a fixing member is provided between a brush hair part and a coupling member, so it is possible to prevent shaking of the brush hair part before coupling the brush body.

DETAILED DESCRIPTION OF THE PREFERRED EMBODIMENT

Figure 1:
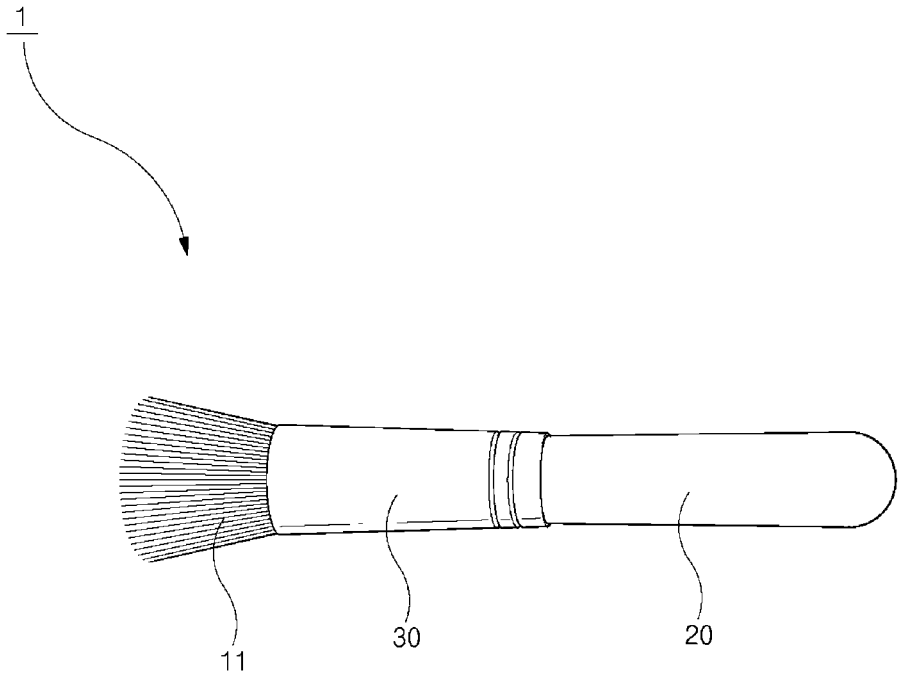
FIG. 1 is a schematic perspective view illustrating a brush according to an embodiment of the present invention.

It is necessary to refer to the accompanying drawings illustrating preferred embodiments of the present invention and those illustrated in the drawings in order to fully understand the present invention, operational advantages of the present invention, and objects accomplished by implementing the present invention.

The present invention is described hereafter in detail by describing preferred embodiments of the present invention with reference to the accompanying drawings. Like reference numerals indicate like components in the drawings.

Figure 2:
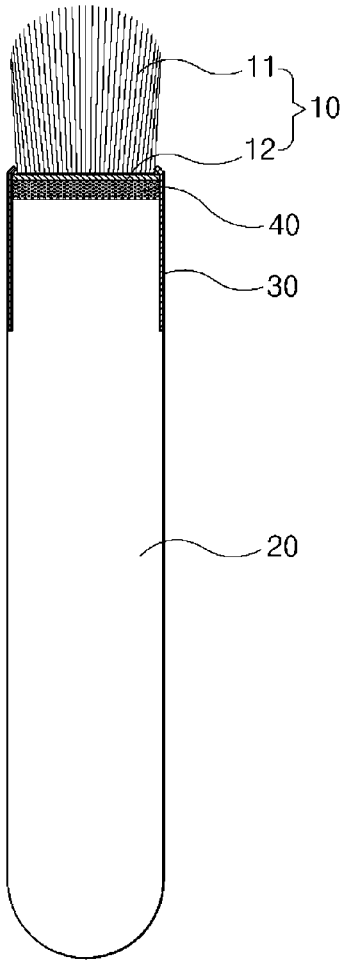
FIG. 2 is a schematic cross-sectional view before a coupling member illustrated in FIG. 1 is pressed.
Figure 3:
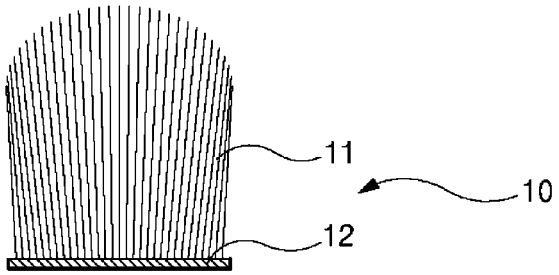
FIG. 3 is a view schematically illustrating a brush hair part illustrated in FIG. 2 in a manufacturing method according to the embodiment.
Figure 4:
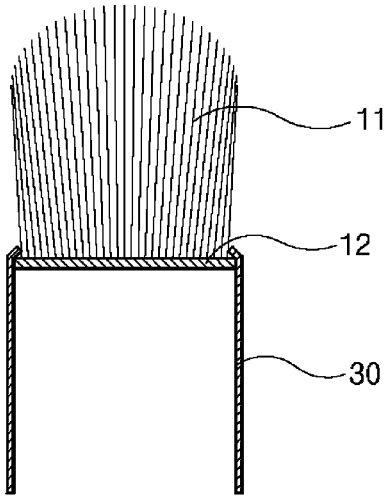
FIG. 4 is a view schematically illustrating the upper end of the coupling member coupled to the part illustrated in FIG. 3 in the manufacturing method according to the embodiment.
Figure 5:
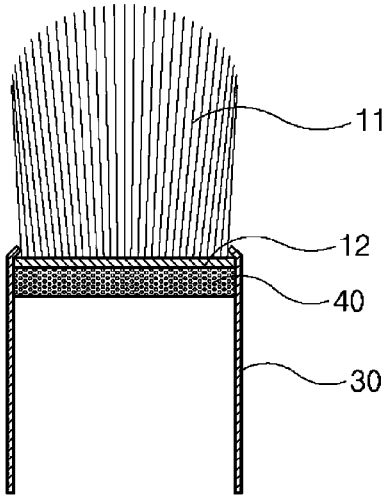
FIG. 5 is a view schematically illustrating the fixing member coupled to the part illustrated in FIG. 4 in the manufacturing method according to the embodiment.
Figure 6:
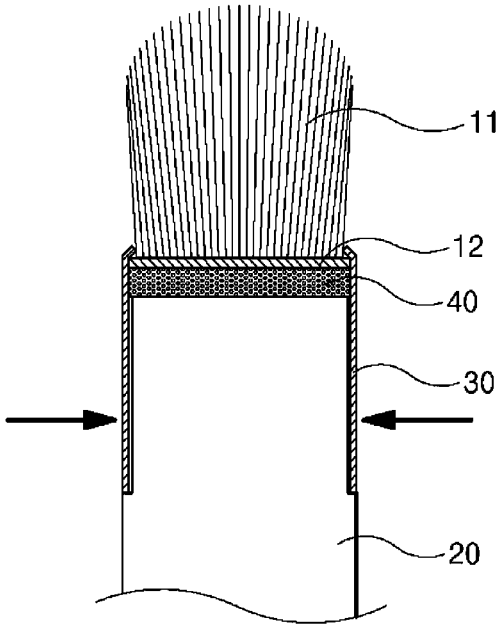
FIG. 6 is a view schematically illustrating when the outer side of the coupling member coupled to the part illustrated in FIG. 5 is pressed in the manufacturing method according to the embodiment.

FIG. 1 is a schematic perspective view illustrating a brush according to an embodiment of the present invention, FIG. 2 is a schematic cross-sectional view before a coupling member illustrated in FIG. 1 is pressed, FIG. 3 is a view schematically illustrating a brush hair part illustrated in FIG. 2 in a manufacturing method according to the embodiment, FIG. 4 is a view schematically illustrating the upper end of the coupling member coupled to the part illustrated in FIG. 3 in the manufacturing method according to the embodiment, FIG. 5 is a view schematically illustrating the fixing member coupled to the part illustrated in FIG. 4 in the manufacturing method according to the embodiment, FIG. 6 is a view schematically illustrating when the outer side of the coupling member coupled to the part illustrated in FIG. 5 is pressed in the manufacturing method according to the embodiment.

As illustrated in the figures, a brush 1 according to the embodiment includes: a brush hair part 10 that has a brush coupler 12 to which brush hairs 11 are attached; a brush body 20 that support an end of the brush coupler 12; a coupling member 30 that has a first part coupled to the brush body 20 and a second part coupled to the edge of the brush coupler 12 and has a metallic tube; and a fixing member 40 that prevents shaking of the brush coupler 12 between the brush body 20 and the brush coupler 12.

The brush hair part 10, as illustrated in FIG. 2, includes the brush hairs 11 and the brush coupler 12 for holding the brush hairs 11.

In the embodiment, the brush hairs 11, as illustrated in FIG. 3, are provided in the area except for the outermost edge of the brush coupler 12. This is for providing an area for coupling the upper end of the coupling member 30 including the metallic tube, around the outermost edge of the brush coupler 12.

The brush body 20 is fitted in contact with the bottom of the fixing member 40 with the upper end inserted in the coupling member 30 illustrated in FIG. 5 and then the area being in contact with the brush body 20 is firmly fixed to the brush hair part 10 by pressing the coupling member 30.

In the embodiment, a step may be formed around the outer side of the upper portion of the brush body 20 to lock and support the coupling member 30.

Further, in the embodiment, the brush body 20 may be made of wood.

The coupling member 30, as illustrated in FIG. 2, couples the brush hair part 10 to the brush body 20, and according to the embodiment, it is possible to couple the coupling member 30 by pressing the coupling member 30 at the area being in contact with the brush body using an apparatus for combining a brush without an adhesive.

In the embodiment, the coupling member 30 may be made of metal and the upper end of the coupling member 30 may be bent toward the brush and locked and supported on the top of the brush coupler 12, as illustrated in FIG. 4.

The fixing member 40, as illustrated in FIG. 5, is inserted in the coupling member 30 of which the upper end is coupled to the brush coupler 12, and supports the bottom of the brush coupler 12. Accordingly, it is possible to prevent shaking of the brush coupler 12 before inserting the brush body 20 into the coupling member 30.

In the embodiment, the fixing member 40 includes a packing and the packing may be made of a high-foamed material (foamed sponge).

Hereafter, a manufacturing method of the embodiment is briefly described with reference to FIGS. 3 to 6.

First, as illustrated in FIG. 3, the brush coupler 12 is manufactured larger in area than the bottom of the brush hairs to support the brush hairs 11 with the brush coupler 12. In the embodiment, the brush hairs 11 and the brush coupler 12 can be combined in the ways well known in the art.

Next, as illustrated in FIG. 4, the upper end of the coupling member 30 is bent and locked to the top of the brush coupler 12.

Thereafter, as illustrated in FIG. 5, the fixing member 40 is inserted into the coupling member 30 to support the bottom of the brush coupler 12.

Finally, as illustrated in FIG. 6, the coupling member 30 is coupled to the brush body 20 by pressing the lower portion of the coupling member 30. In the embodiment, the coupling member 30 may be pressed semi-automatically by the apparatus for combining a brush to be described below.

Figure 7:
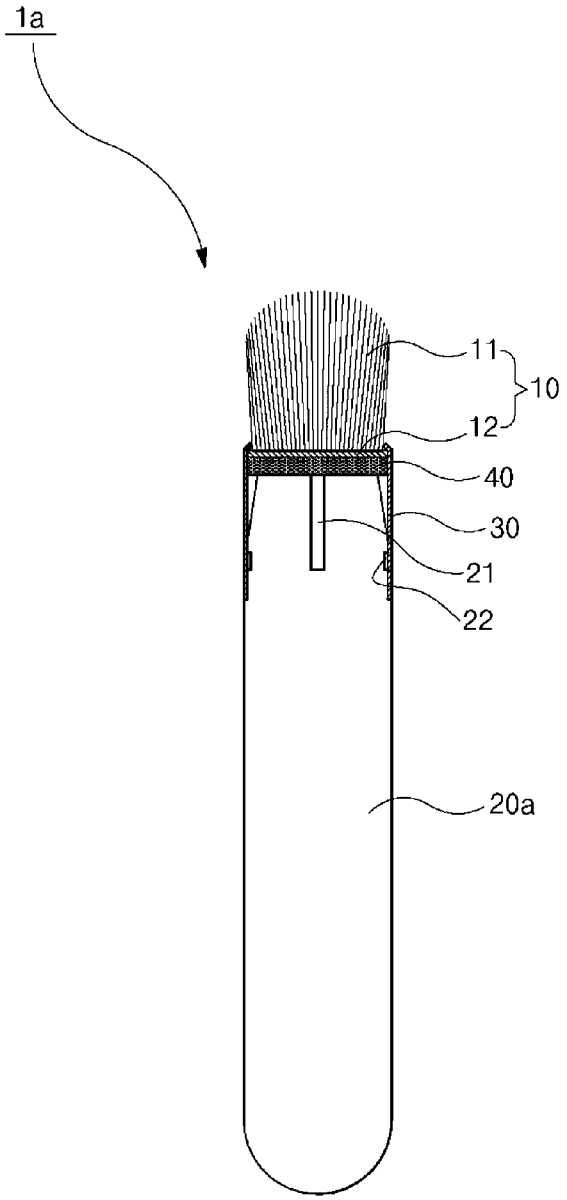
FIG. 7 is a schematic cross-sectional view illustrating a brush according to another embodiment of the present invention.
Figure 8:
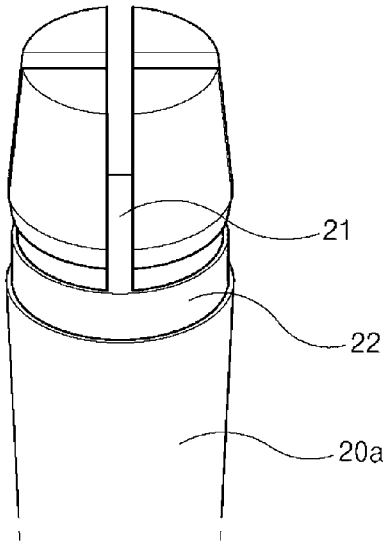
FIG. 8 is an enlarged view illustrating the upper portion of a brush body illustrated in FIG. 7.

FIG. 7 is a cross-sectional view schematically illustrating a brush according to another embodiment and FIG. 8 is an enlarged view illustrating the upper portion of the brush body illustrated in FIG. 7.

A brush 1*a* according to the embodiment, as illustrated in FIGS. 7 and 8, is different from the previous embodiment in that a cut groove and a pressing groove are formed on a brush body 20*a*. This configuration has been determined in consideration of the brush body 20*a* made of metal.

That is, when the brush body 20*a* is made of metal and the coupling member 30 is pressed without forming a specific groove on the brush body 20*a*, the coupling member 30 is not appropriately pressed, so combining is difficult.

According to the embodiment considering the problem, as illustrated in FIGS. 7 and 8, a pressing groove is formed on the brush body 20*a*, so an insertion space for the coupling member 30 can be provided.

Further, according to the embodiment, a plurality of cut grooves is formed on the top of the brush body 20*a*, so the brush body 20*a* can be easily inserted into the coupling member 30.

Figure 9:
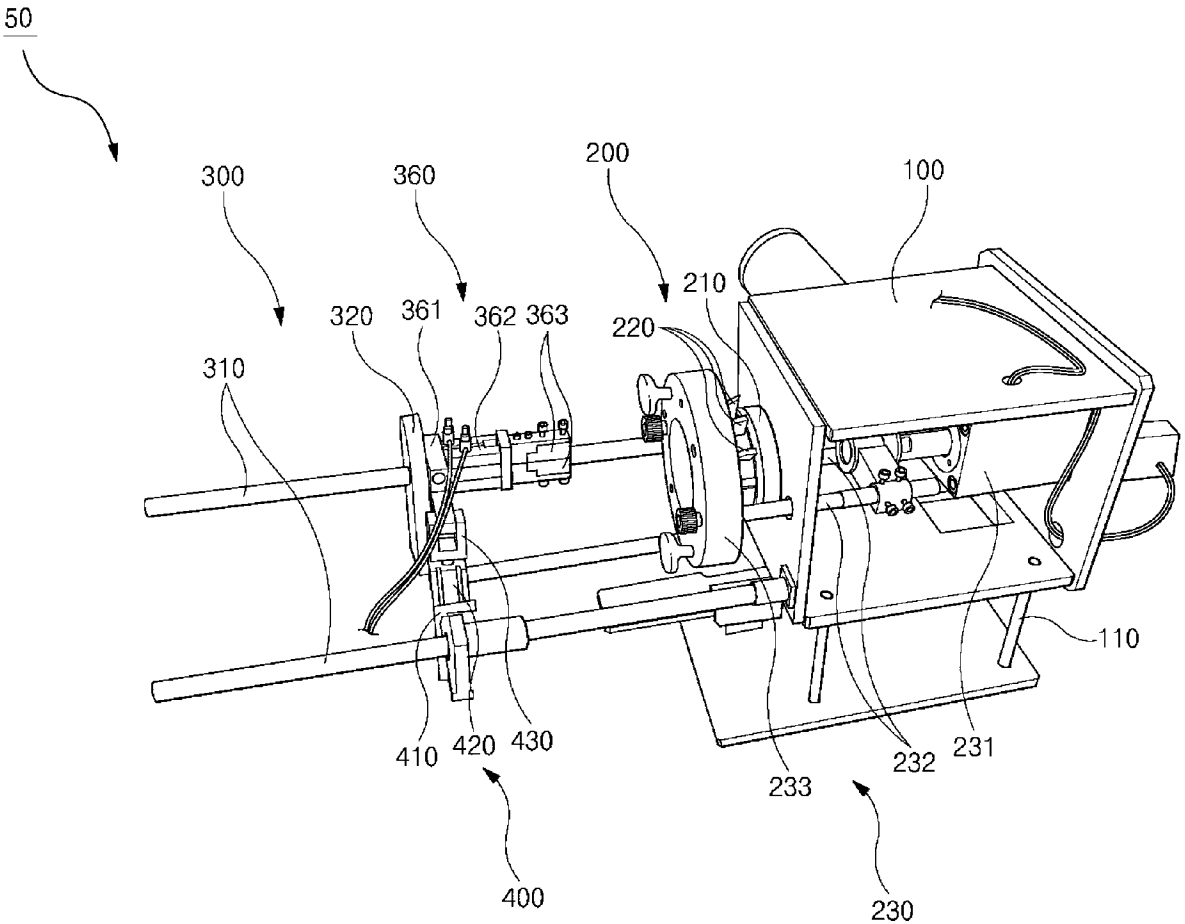
FIG. 9 is a perspective view schematically illustrating an apparatus for combining a brush that is used for coupling the coupling member of the embodiment.

On the other hand, the coupling member 30 can be pressed in the embodiment by the apparatus 50 for combining a brush illustrated in FIG. 9.

Figure 10:
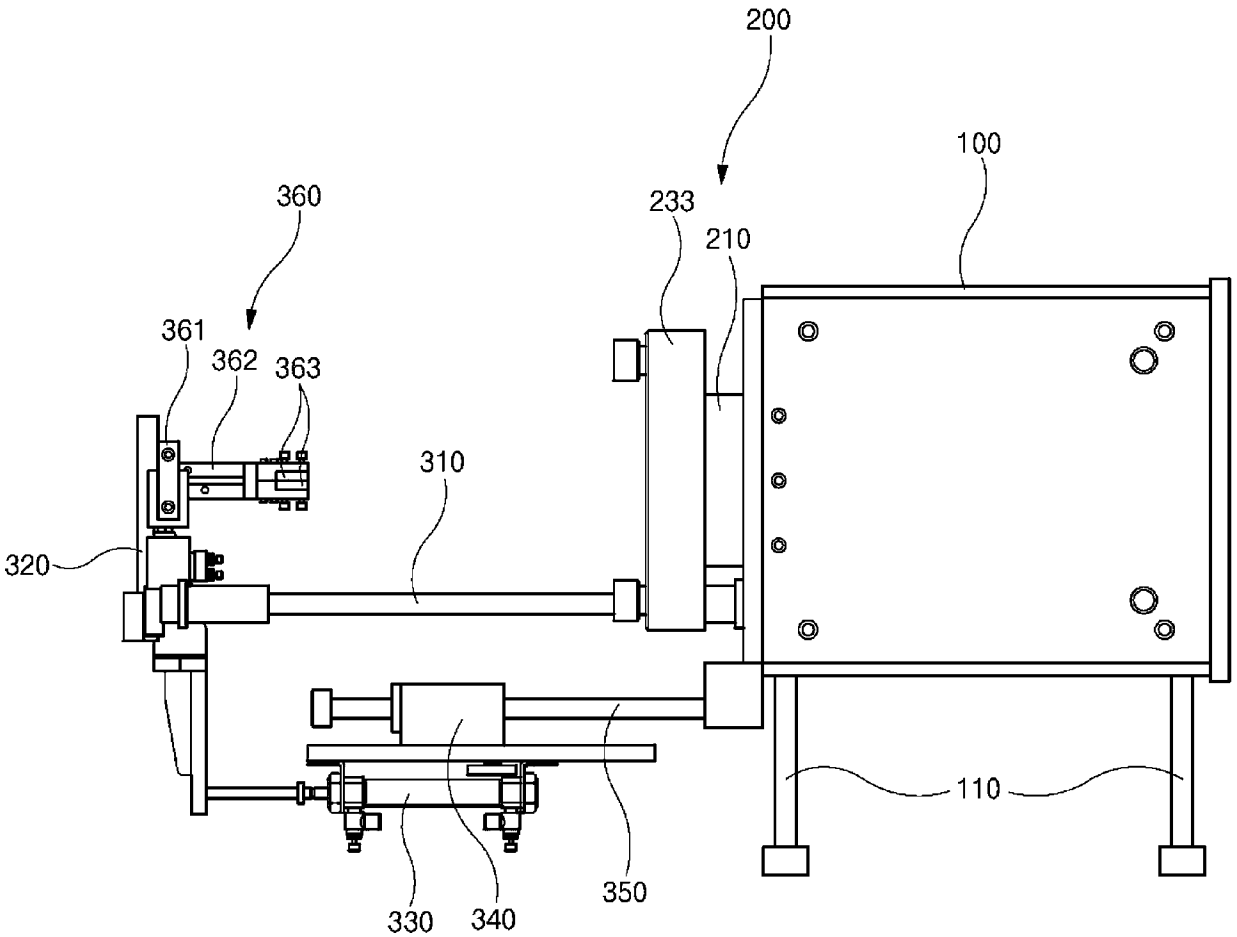
FIG. 10 is a schematic side view of the apparatus illustrated in FIG. 9.
Figure 11:
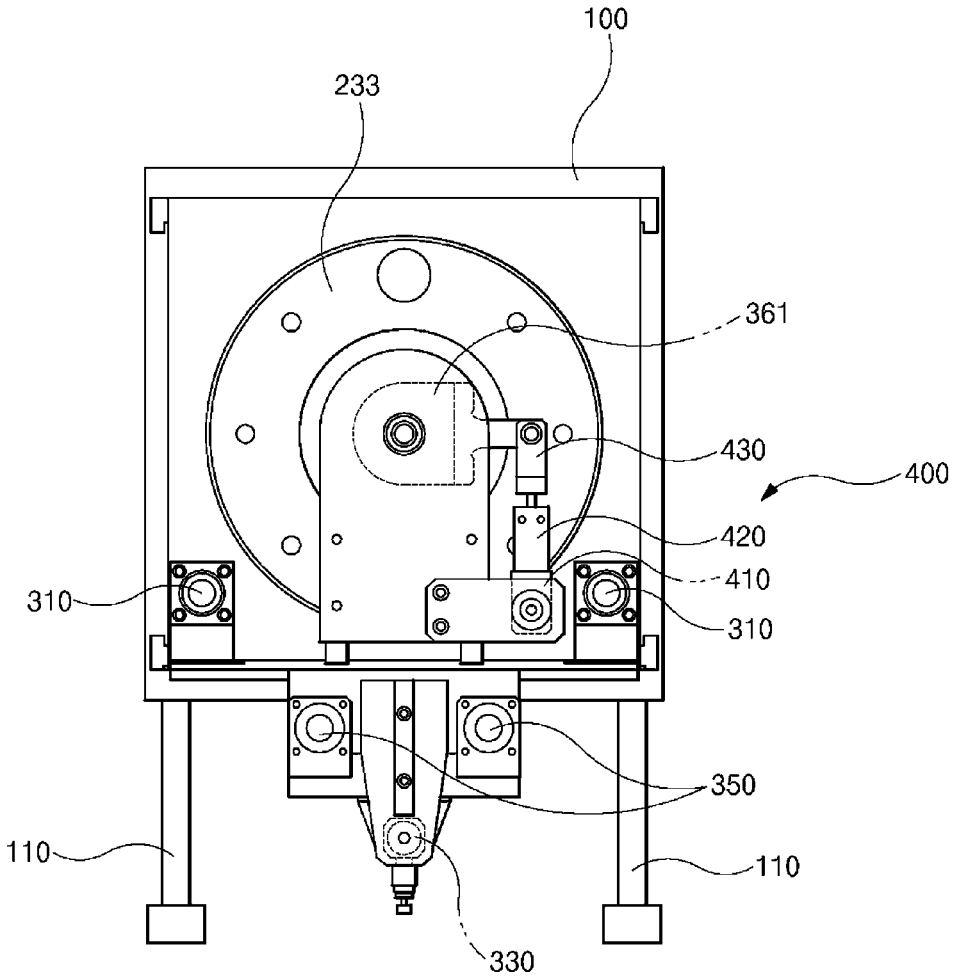
FIG. 11 is a front view of the apparatus illustrated in FIG. 9.
Figure 12:
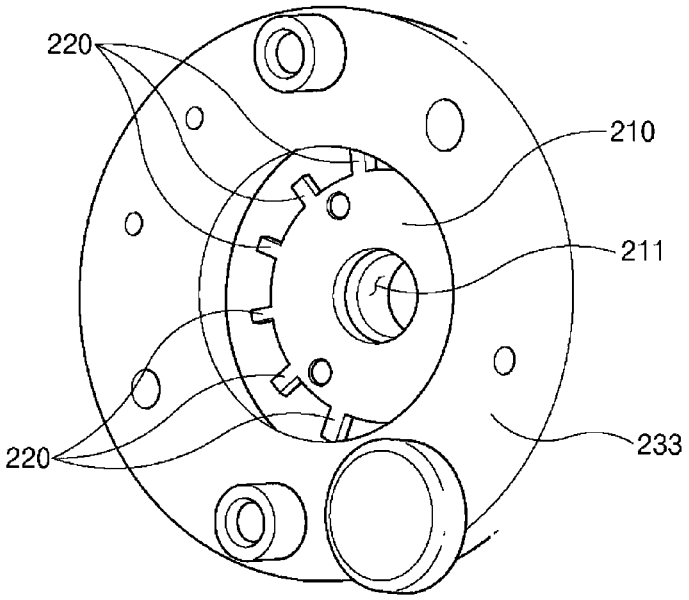
FIG. 12 is an enlarged view of a pressing head illustrated in FIG. 9.
Figure 13:
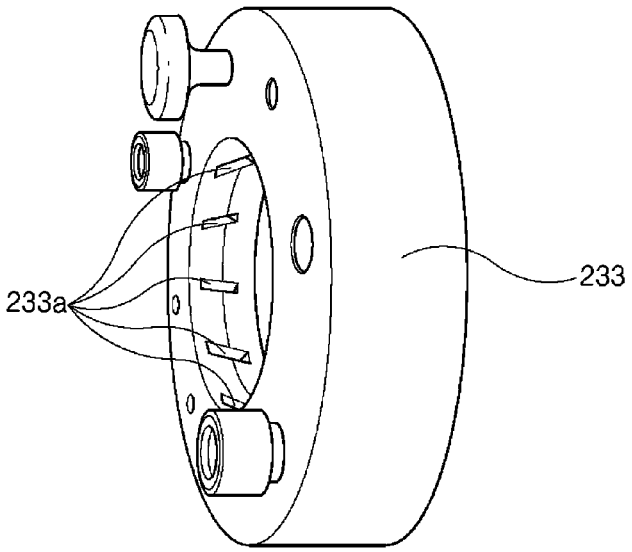
FIG. 13 is an enlarged view of the pressing head illustrated in FIG. 9.
Figure 14:
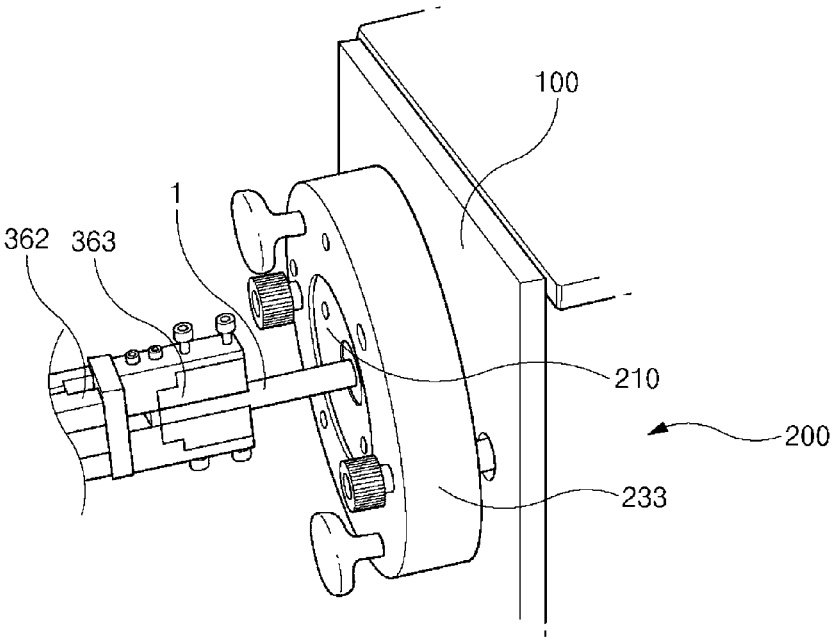
FIG. 14 is a perspective view schematically illustrating that the pressing head illustrated in FIG. 9 has moved to a pressing body.

FIG. 9 is a perspective view schematically illustrating an apparatus for combining a brush that is used for coupling the coupling member of the embodiment, FIG. 10 is a schematic side view of the apparatus illustrated in FIG. 9, FIG. 11 is a front view of the apparatus illustrated in FIG. 9, FIG. 12 is an enlarged view of a pressing head illustrated in FIG. 9, FIG. 13 is an enlarged view of the pressing head illustrated in FIG. 9, and FIG. 14 is a perspective view schematically illustrating that the pressing head illustrated in FIG. 9 has moved to a pressing body.

An apparatus 50 for combining a brush according to the embodiment includes: a brush-fitting unit 200 that is coupled to a main body 100 and couples a coupling member 30 for fixing a brush hair part 10 of a brush 1 to a brush body 20 by pressing the coupling member 30; a brush-feeding unit 300 that is coupled to the main body 100 to feed the brush 1 to the brush-fitting unit; and a brush-rotating unit 400 that is combined with the brush-feeding unit 300 and rotates the brush 1.

The main body 100, as illustrated in FIG. 9, may be formed in the shape of a hollow hexahedron and may be supported by a plurality of legs 110.

In the embodiment, the main body 100 may be made of metal and a driving motor 231 may be disposed inside the main body 100.

The brush-fitting unit 200 assembles a brush by pressing the coupling member 30 including a metallic tube illustrated in FIG. 2 with mechanical force without using an adhesive on the brush body 20.

In the embodiment, the brush-fitting unit 200, as illustrated in FIG. 9, includes a pressing body 210 that is disposed on the front of the main body 100 and has a center hole 211 at the center, a plurality of pressing projections 220 that each have a first end protruding outward from the center hole 211 of the pressing body 210 to press the coupling member 30 and a second end exposed out of the pressing body 210, and projection-actuating mechanism 230 that is combined with the main body 100 and moves the plurality of pressing projections 220 to the center of the center hole 211 to press the coupling member 30.

The pressing body 210 of the brush-fitting unit 200, as illustrated in FIGS. 9 and 12, may be formed in a circular shape and is coupled to the main body 100, so it is fixed in different way from the pressing head 233.

In the embodiment, the brush body 20 fitted in the coupling member 30 is inserted into the center hole 211 of the pressing body 210 to be pressed by the plurality of pressing projections 220.

In the plurality of pressing projections 220 of the brush-fitting unit 200, as illustrated in FIG. 9, the first ends are not exposed to the center hole 211 of the pressing body 210 and the second ends are exposed outward from the outer circumferential side of the pressing body 210, before the pressing body 210 is surrounded by the pressing head 233.

In this state, when the pressing head 233 is moved toward the main body 100 and surrounds the pressing body 210, as illustrated in FIG. 14, the plurality of pressing projections 220 are moved toward the center of the center hole 211 by pressing force of the pressing head 233 and press the coupling member 30 surrounding the brush body 20, thereby coupling the coupling member 30 to the brush body 20.

When the pressing head 233 returns to the initial position, the plurality of pressing projections 220 are returned to the initial positions by restoring force of springs in the pressing body 210. In the embodiment, the first ends are fixed in grooves in the pressing body 210 and the second ends are fixed to the pressing projections 220, so the plurality of pressing projections 220 can be elastically returned by the springs (not illustrated).

In the embodiment, the plurality of pressing projections 220 exposed on the outer circumferential side of the pressing body 210, as illustrated in FIG. 9, may be inclined outward as they go to the main body 100 and may be gentle as they go far away from the main body 100. In this case, it is possible to smoothly move the plurality of pressing projections 220 when pressing with the pressing head 233.

The projection-actuating mechanism 230 of the brush-fitting unit 200, as illustrated in FIG. 9, is combined with the main body 100 and presses and couples the coupling member 30 to the brush body 20 by moving the plurality of pressing projections 220 into the center hole 211 of the pressing body 210.

The projection-actuating mechanism 230 in the embodiment, as illustrated in FIG. 9, includes the driving motor 231 disposed inside the main body 100, a pair of moving rods 232 each having a first part connected to the driving motor 231 and a second part moved forward/backward through the front side of the main body 100 by the driving motor 231, and the pressing head 233 designed to be coupled to ends of the pair of moving rods 232 to move with the pair of moving rods 232 and to surround the outer circumferential side of the pressing body 210 to move the plurality of pressing projections 220.

The pressing head 233 of the projection-actuating mechanism 230, as illustrated in FIG. 9, may be formed in a circular shape and the center of the pressing head 233 is bored.

In the embodiment, a plurality of head grooves 233*a* is formed in the inner side of the pressing head 233, as illustrated in FIG. 13. In the embodiment, the plurality of head grooves 233*a* may be formed at positions corresponding to the plurality of pressing projections 220 and inclined to correspond to the inclination of the plurality of pressing projections 220.

The brush feeding unit 300 holds the brush 1 to be machined and moves it back and forth to the brush-fitting unit 200.

In the embodiment, the brush-feeding unit 300, as illustrated in FIGS. 9 and 10, includes: a pair of moving guide rods 310 coupled to the main body 100; a moving body 320 fitted on the pair of moving guide rods 310 to move in the longitudinal direction of the moving guide rods 310; a moving cylinder 330 connected to the moving body 320 to move the moving body 320; a moving cylinder-fixing body 340 combined with the moving cylinder 330; connecting rods 350 having a first part coupled to the main body 100 and a second part combined with the moving cylinder-fixing body 340; and a brush holder 360 coupled to the moving body 320 to hold the brush 1.

First ends of the pair of moving guide rods 310 of the brush-feeding unit 300 may be detachably bolted to the main body 100 and guide the moving body 320 sliding forward/backward with the brush holder 360 thereon.

The moving cylinder 330 of the brush-feeding unit 300, as illustrated in FIG. 10, is connected to the moving body 320 through a rod and moves the moving body 320 in the longitudinal direction of the moving guide rod 310. Accordingly, the brush holder 360 coupled to the moving body 320 to fix the brush 1 is correspondingly moved forward/backward.

In the embodiment, the moving cylinder 330 may be pneumatic cylinder that is operated by air pressure.

The moving cylinder 330 is bolted through a bracket under the moving cylinder-fixing body 340 of the brush-feeding unit 300, as illustrated in FIG. 10, and the top of the moving cylinder 330 may be detachably bolted to the connecting rods 350.

The connecting rods 350 of the brush-feeding unit 300, as illustrated in FIG. 10, may be detachably bolted to the main body 100 at first ends.

The brush holder 360 of the brush-feeding unit 300 automatically holds and releases the brush 1.

In the embodiment, the brush holder 360, as illustrated in FIG. 9, includes a holder body 361 coupled to the moving body 320, a holder motor 362 coupled to the holder body 361, and a pair of holder tongs 363 connected to the holder motor 362 to hold the brush 1.

The holder body 361 of the brush holder 360 may be rotatably coupled to the moving body 320. For example, a shaft may be provided to the moving body 320 with a bearing and the holder body 361 may be fitted on the bearing.

The holder motor 362 of the brush holder 360 may be a pneumatic motor that is operated by air pressure and opens or closes the pair of holder tongs 363 in the height direction of the pneumatic motor, whereby it is possible to hold the brush 1. In the embodiment, connecting and operating the holder motor 362 and the pair of holder tongs 363 may be achieved by the technology that is generally used in the field of robotic engineering, and the like.

The brush-rotating unit 400 rotates the brush holder 360 at a predetermined angle, for example, about 20 degrees to press another part of the coupling member 30 that has been pressed one time by the brush-fitting unit 200.

In the embodiment, the brush-rotating unit 400, as illustrated in FIG. 9, includes a base body 410 bolted to the moving body 320, a rotating motor 420 coupled to the base body 410, and a rotary connector 430 having the bottom connected to the rotating motor 420 and the top connected to the holder body 361 to rotate the brush holder 360.

In the embodiment, the rotating motor 420 moves up or down the rotary connector 430 and an end of the holder body 361 is connected to the rotary connector 430, as illustrated in FIG. 11. The holder body 361, as described above, is rotatably coupled by a bearing, and the like, so when the rotary connector 430 is moved down by the rotating motor 420, the holder body 361 connected to the rotary connector 430 is rotated clockwise in FIG. 11. Accordingly, the brush 1 fixed by the pair of holder tongs 363 is also rotated clockwise.

The operation of the embodiment is briefly described hereafter with reference to the drawings.

First, the brush hair part 10 and the brush body 20 fitted in the coupling member 30 are inserted between the pair of holder tongs illustrated in FIG. 9. Thereafter, the brush holder 360 is moved to the center hole 211 of the pressing head 233 by operating the brush-feeding unit 300.

In this state, the pressing head 233 is moved toward the front side of the main body 100 by operating the brush-fitting unit 200. As illustrated in FIG. 14, when the pressing head 233 surrounds the outer circumferential side of the pressing body 210, the plurality of pressing projections 220 protrude into the center hole 211 of the pressing body 210 and press the coupling member 30 fitted on the brush body 20, thereby fixing the fixing member 30 to the brush body 20.

Thereafter, the pressing head 233 is returned to the initial position and then the brush-rotating unit 400 is operated, whereby the brush holder 360 is rotated at a predetermine angle, about 20 degrees. The pressing head 233 is moved again to surround the pressing body 210, thereby pressing the coupling member 30 with the plurality of pressing projections 220. Accordingly, sequential grooves are formed on the coupling member 30, as illustrated in FIG. 1.

Finally, the finished brush 1 is returned to the brush-feeding unit 300 after the pressing head 233 is returned to the initial position, and then the brush 1 is released from the pair of holder tongs 363.

As described above, according to the embodiment, a coupling member and a brush body are combined by pressing the portion of the coupling member where the coupling member and the brush body are in contact with each other, so they can be combined without an adhesive and it is possible to preclude harmful substances of an adhesive.

Further, a fixing member is provided between a brush hair part and a coupling member, so it is possible to prevent shaking of the brush hair part before coupling the brush body.

It is apparent to those skilled in the art that the present invention is not limited to the embodiments described above and may be changed and modified in various ways without departing from the spirit and the scope of the present invention. Accordingly, the changed and modified examples should be construed as being included in claims of the present invention.

What is claimed is:

1. A method of manufacturing a brush, the method comprising:

bending the upper end of a coupling member including a metallic tube and coupling the bent upper end to the edge of a brush coupler combined with brush hairs;

supporting the brush coupler with a fixing member by inserting the fixing member into the coupling member;

inserting the upper portion of a brush body into the coupling member to support the fixing member; and coupling the coupling member to the brush body by pressing a portion of the coupling member where the coupling member and the brush body are in contact with each other.

2. The method of claim 1, wherein the coupling member and the brush body are pressed by an apparatus for combining a brush.

* * * * *